US005802913A

United States Patent [19]

Winner

[11] Patent Number: 5,802,913

[45] Date of Patent: Sep. 8, 1998

[54] WINDOW OPERATOR

[76] Inventor: Kurt W. Winner, 133 Polihale Pl., Honolulu, Hi. 96825

[21] Appl. No.: 858,696

[22] Filed: May 19, 1997

[51] Int. Cl.[6] ..... E05F 11/24

[52] U.S. Cl. ..... 74/89.18; 49/333; 49/342; 74/606 R

[58] Field of Search ..... 74/89.18, 89.19, 74/606 R; 49/333, 335, 339, 342, 324

[56] References Cited

U.S. PATENT DOCUMENTS

| | | | |
|---|---|---|---|
| 1,422,552 | 7/1922 | Fournier | 49/342 |
| 2,214,280 | 9/1940 | Lang | 49/342 |
| 2,635,485 | 4/1953 | Gravenstine et al. | 74/606 R |
| 2,929,264 | 3/1960 | Martin | 49/342 |
| 4,037,483 | 7/1977 | Nada | 74/32 |
| 4,505,601 | 3/1985 | Sandberg et al. | 384/428 |
| 5,531,138 | 7/1996 | Vetter | 74/606 R |

*Primary Examiner*—Charles A. Marmor
*Assistant Examiner*—Troy Grabow
*Attorney, Agent, or Firm*—Oppenheimer Wolff & Donnelly LLP

[57] ABSTRACT

A casement and awning window operator consisting of four parts, a top cover, a base, a worm gear receivable in a pocket on the base and top and a geared actuating arm engaging the worm gear having an integral arm extending out of the operator. The cover is secured to the base by an adhesive applied to matching surfaces of the cover and base trapping the worm gear therein. The cover and base are made from two plastic halves in a generally horizontal parting plane thus presenting a large adhesive contact area in a plane putting the contact surfaces in shear and allowing insertion of the gear and arm prior to assembly. The cover and base may have molded parts providing a spring-like effect to control the friction of the operator to prevent it from rotating out of a set position.

8 Claims, 5 Drawing Sheets

WINDOW OPERATOR

BACKGROUND OF THE INVENTION

1. Field of the Invention

The invention relates to window operators; and, more particularly, to an operator for opening and closing vented windows.

2. Background Information

Rotary operators on casement and awning windows are generally manufactured from metal or stainless activating arms, including a heat treated worm gear, all mounted in a zinc die cast housing.

The zinc housing is expensive to manufacture, particularly in the preparation and painting thereof. It offers poor wear characteristics on the worm gear thrust surfaces, and it is highly corrosive, particularly in seaside salty environments, where salt and moisture cause electrolytic corrosion between the zinc and other metal components. It is not uncommon for an operator to fail in less than a year in "salt moist" environments.

Another problem with rotary operators, as discussed in U.S. Pat. No. 4,505,601 to Sandberg, et al., is the difficulty in obtaining the proper amount of controlled friction in the mechanism itself so that buffeting winds on a window panel do not cause the operator to gradually rotate out of set position.

Sandberg et al. accomplishes this by screwing in a retaining plug against the end face of the worm gear, in between which is sandwiched a bellville or bent washer. The adjustment of the retaining plug acts to flatten out the bellville washer causing a controlled frictional adjustment after which the plug is staked in place by deforming the die cast housing into machined recesses in the retaining plug, thereby preventing further plug rotation. Such metallic parts may fail in "salt moist" environments or at least become less efficient.

There is thus a need for a casement and awning window operator that eliminates the corrosion encountered in such prior art operators and reduces the number of parts. Such an operator should eliminate the electrolysis encountered in such prior art operators and eliminate the frictional problems associated with the steel to zinc contact in such operators, and be less expensive to manufacture. An improved operators should work efficiently in "salt moist" environments to retain the operator in a set position.

SUMMARY OF THE INVENTION

It is an object of this invention to provide a casement and awning window operator that eliminates the corrosion encountered by such operators, particularly in seaside salty environment.

It is another object of this invention to provide a casement and awning window operator consisting of only four parts.

It is still further an object of this invention to provide a casement and awning window operator that eliminates electrolysis and frictional problems between the parts thereof.

It is still further an object of this invention to control the friction of the operator so that it does not rotate out of a set position when the window panel is affected by buffeting winds.

These and other objects are preferably accomplished by providing a casement and awning window operator consisting of four parts, a top cover, a base, a worm gear receivable in pockets in the base and top cover and a geared actuating arm engaging the worm gear having an integral arm extending out of the operator. The cover is secured to the base by an adhesive applied to mating surfaces of the cover and base trapping the worm gear and actuating arm therebetween. The cover and base is made from two plastic halves in a generally horizontal parting plane thus presenting a large adhesive contact area in a plane putting the contact surfaces in shear and allowing insertion of the gear and arm prior to assembly. In one embodiment of the invention, a spring-like effect is carried out by parts molded in worm gear pocket to control the friction of the operator to prevent it from rotating out of a set position.

DESCRIPTION OF THE PREFERRED EMBODIMENT

Figure 1:
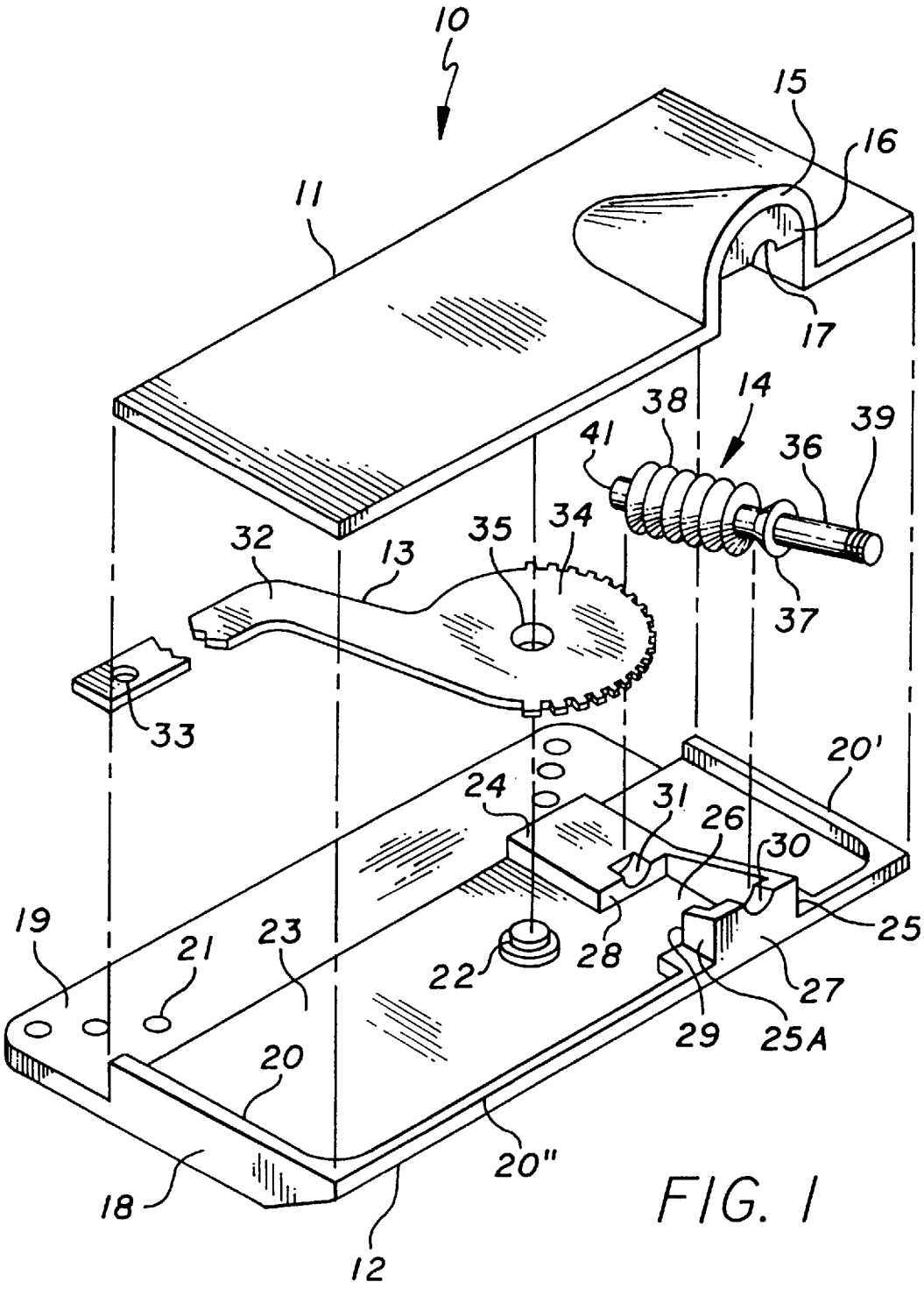
FIG. 1 is an exploded view of a window operator in accordance with the teachings of the invention.

Referring now to FIG. 1 of the drawing, a hinged window operator 10 is shown in exploded view consisting of only 4 parts, a top cover 11, a base 12, actuating arm 13, and a worm gear 14.

Figure 2:
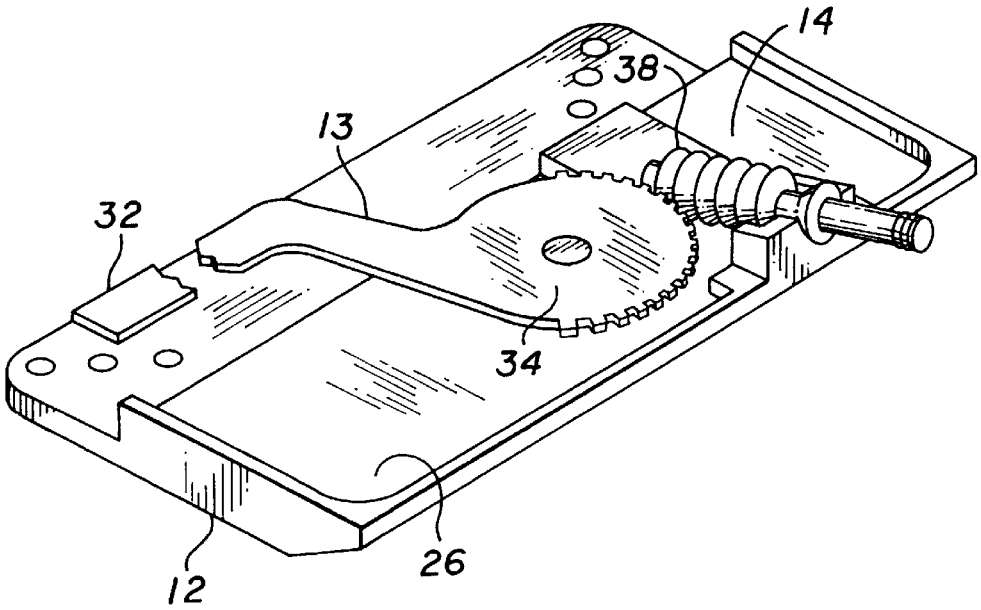
FIG. 2 is a partially assembled perspective view of the operator of FIG. 1, the cover being omitted for convenience of illustration.
Figure 3:
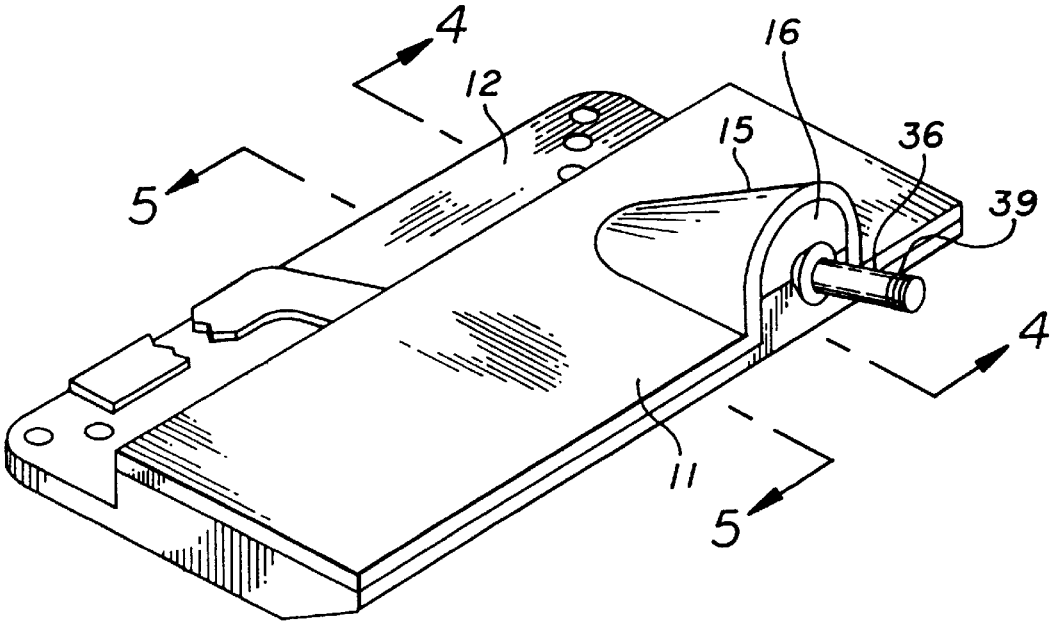
FIG. 3 is a final assembled perspective view of the operator of FIGS. 1 and 2.

Operator 10 is shown in partially assembled view in FIG. 2 and final assembled view in FIG. 3. Thus, as seen in FIG. 1, operator 10 includes a generally flat rectangular cover 11 having a raised portion 15 forming an arch along one side thereof extending substantially transverse to the longitudinal axis of cover 11.

Base 12 is also generally rectangular and flat having a main body portion 18 and an integral flat flange portion 19, also generally flat and rectangular, extending along one elongated side of main body portion 18. A peripheral upstanding wall 20 extends along both sides 20, 20' of main body portion 18 and the front 20" thereof (opposite flange 19). Flange 19 has a plurality of spaced apertures 21 therethrough for securing flange 19 in a desired location. A generally cylindrical pivot pin 22 is provided upstanding from the surface 23 of main body portion 18.

An upstanding wall portion 24 is also provided on surface 23 spaced from side 20' extending from the intersection of flange 19 and main body portion 18 to a raised portion 25. Raised portion 25 has an inner cavity 26 between front wall portion 27 and rear wall portion 28. A like mating cavity **26*a* is formed in top cover 11 (see FIG. 4). As seen in FIG. 1, an opening 29 leads into cavity 26 and bearing surfaces 30, 31 are provided at the upper ends of front and rear wall portions 27, 28, respectively. As seen in FIG. 1, cavity 26 slopes from the front to the rear as shown (wall portion 27 being higher than wall portion 28**).

Actuating arm 13 has an elongated arm portion 32 which may have an opening 33 at the terminal end thereof for coupling the same to suitable window attachment mechanism (not shown) as is well known in the art. Arm 13 has an integral rounded tooth-geared portion 34 having an aperture 35 therethrough for receiving pin 22 therein as seen in FIG. 2.

Worm gear 14 includes an elongated shaft 36 having an integral tapered portion 37 and an integral worm gear portion 38. Shaft 36 also has a spline portion 39 adapted to mate with the socket 100 of a crank handle 101 as seen in FIG. 4.

Figure 4:
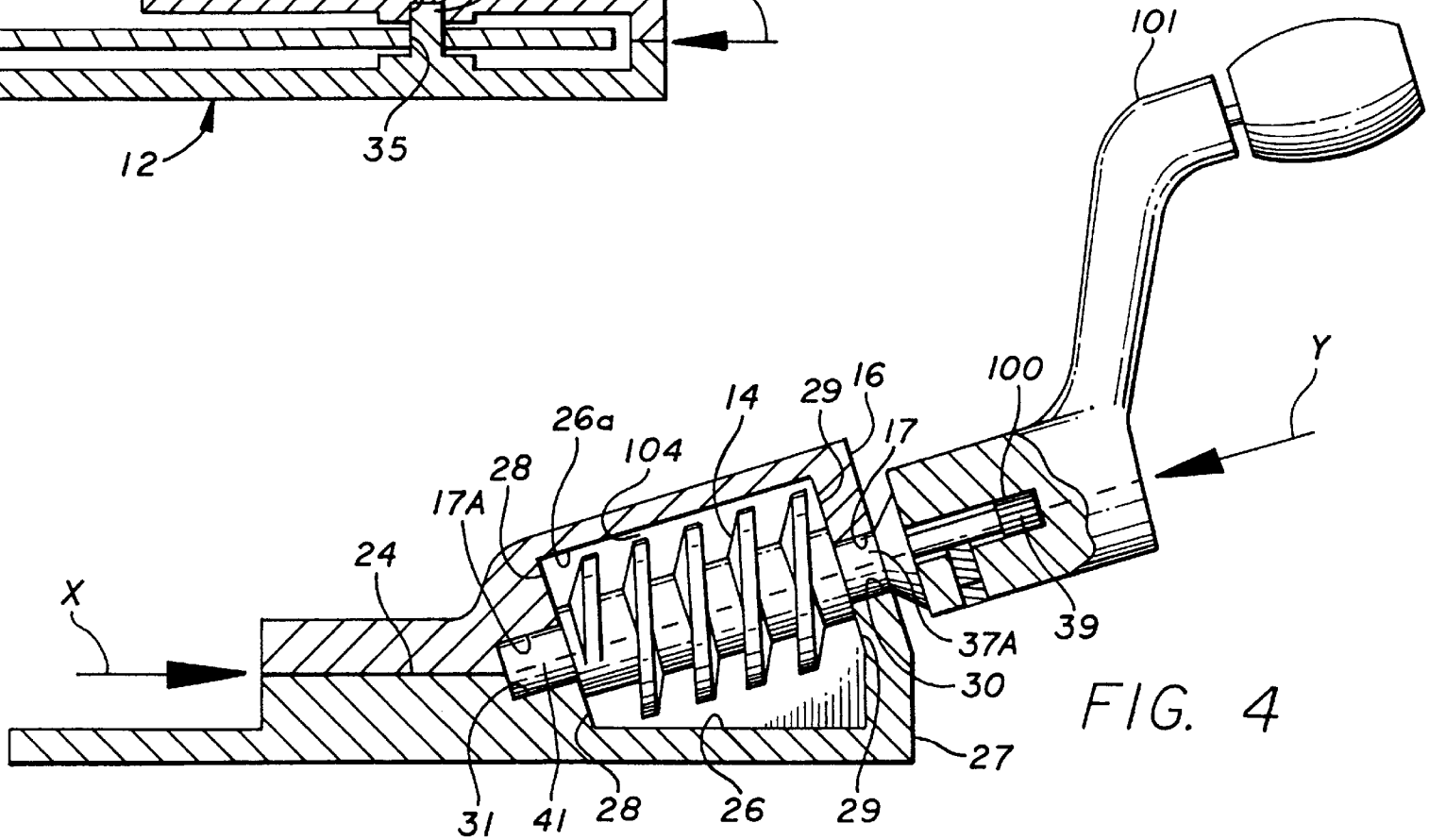
FIG. 4 is a cross-sectional view taken along lines 4—4 of FIG. 3.

As seen in FIG. 4, worm gear 14 is mounted onto base 12 by placing worm gear portion 38 into cavity 26 with journal portion 37A resting in bearing surface 30 in front wall 27 and the bearing journal end 41 of worm gear 14 resting in bearing surface 31 of rear wall 28.

Lower cavity 26 and bearing surfaces 30, 31 are thus duplicated in the top cover 11 providing upper cavity 26*a* and bearing surfaces 17, 17*a* to trap worm gear 14 therein. Bearing surfaces 30 and 17 act to capture the worm journal 37*a* at the outside end whereas surface 31 interacts with a like surfaced 17*a* in the cover 11 to capture the inner journal 41.

Figure 5:
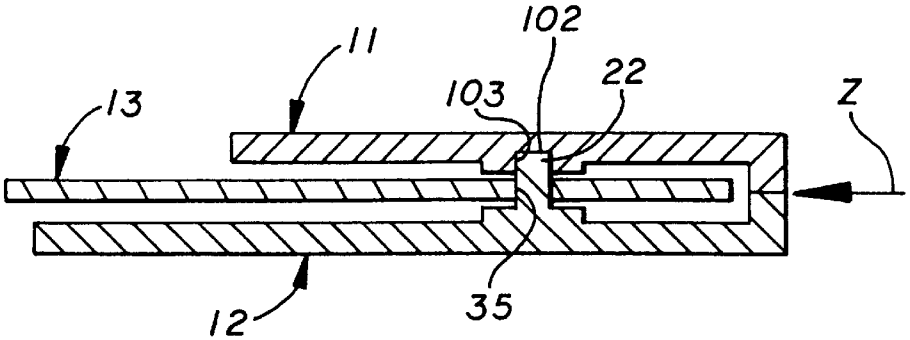
FIG. 5 is a cross-sectional view taken along lines 5—5 of FIG. 3.

Actuating arm 13 is mounted on base 12 by means of pin 22 being receivable in opening 35 in arm 13 with the gears of geared portion 34 engaging in meshing relationship with worm gear portion 38. The arm 32 extends rearwardly of base 12. The upper end 102 of pin 22 is receivable in a hole 103 in cover 11 as seen in FIG. 5. This adds strength to the structure.

Glue or any other suitable adhesive is now applied to all contacting surfaces of cover 11 and base 12, such as the upper surfaces of peripheral walls 20, 20', 20", 24, 25, and 25A. Cover 11 is now placed on top and secured thereto, the shaft 36 of worm gear 14 extending outwardly as shown. The worm gear 14 is journalled in the mating surfaces as discussed. A clearance area 104 is provided between worm gear 14 and the wall of cavity 26*a* as seen in the final assembly in FIG. 4.

Portion 39 of worm gear 14 may be quickly and easily coupled to crank handle 101 for rotating the same. Aperture 33 allows arm 13 to be coupled to any suitable window attachment mechanism, as, for example, the links coupled to arm 20 via hole 23 disclosed in U.S. Pat. No. 4,037,483.

It can be seen that my invention is directed to a window operator consisting of only four parts, two mating housing parts (cover 11 and base 12), which may be molded from plastic, and worm gear 14 (which may be of bronze or heat treated stainless steel) and arm 13 (which may be of stainless steel). Such a combination eliminates corrosion by substituting high performance plastic for the zinc normally used in prior art window operators. The device is manufactured in two halves (parts 11 and 12) in a generally horizontal parting plane as indicated by arrows x and y in FIG. 4 and z n FIG. 5. This accomplishes two important things: 1) the parting plane, which is designed for adhesive assembly, presents the largest possible adhesive contact area in a plane that puts the contact surfaces in <u>shear</u> (as opposed to tension) so that the operating forces (separation forces of the worm gear 14 and tooth gear 34 of the arm 13) are distributed in a shear manner as opposed to the weaker tension manner, i.e., if the part were split in a vertical plane; b) the longitudinal split allows for the insertion of the worm gear 14 and the operating arm 13 <u>prior</u> to assembly. This in turn eliminates the need for a secondary arm pivot pin assembly since pin 22 may be part of the molded housing 12, and it eliminates the need for a worm gear retaining plug as in prior art devices and all the machining operations associated therewith (for example, see U.S. Pat. No. 4,505,601 to Sandberg et al.). The precision pocket or cavity 26, which may be molded on base 12 and the mating cavity 26*a* in top 11, that receives the worm gear 14, offers plastic thrust surfaces for the worm gear 14. Plastic to metal contact of worm gear 14 and cover 11 and base 12 eliminates electrolysis and eliminates the frictional problems associated with steel acting against zinc as in certain prior art window operators.

Furthermore, the plastic housing parts 11, 12 may be molded in any color, will not chip as paint will, and eliminate all the secondary operations normally performed to a prior art zinc die cast part . . . i.e., deflashing, tumbling, surface etching and cleaning, priming and painting.

A two part plastic housing, as parts 11, 12, is designed for adhesive assembly that drastically reduces manufacturing cost and assembly time while improving performance, long term appearance and eliminates corrosion.

Figure 6:
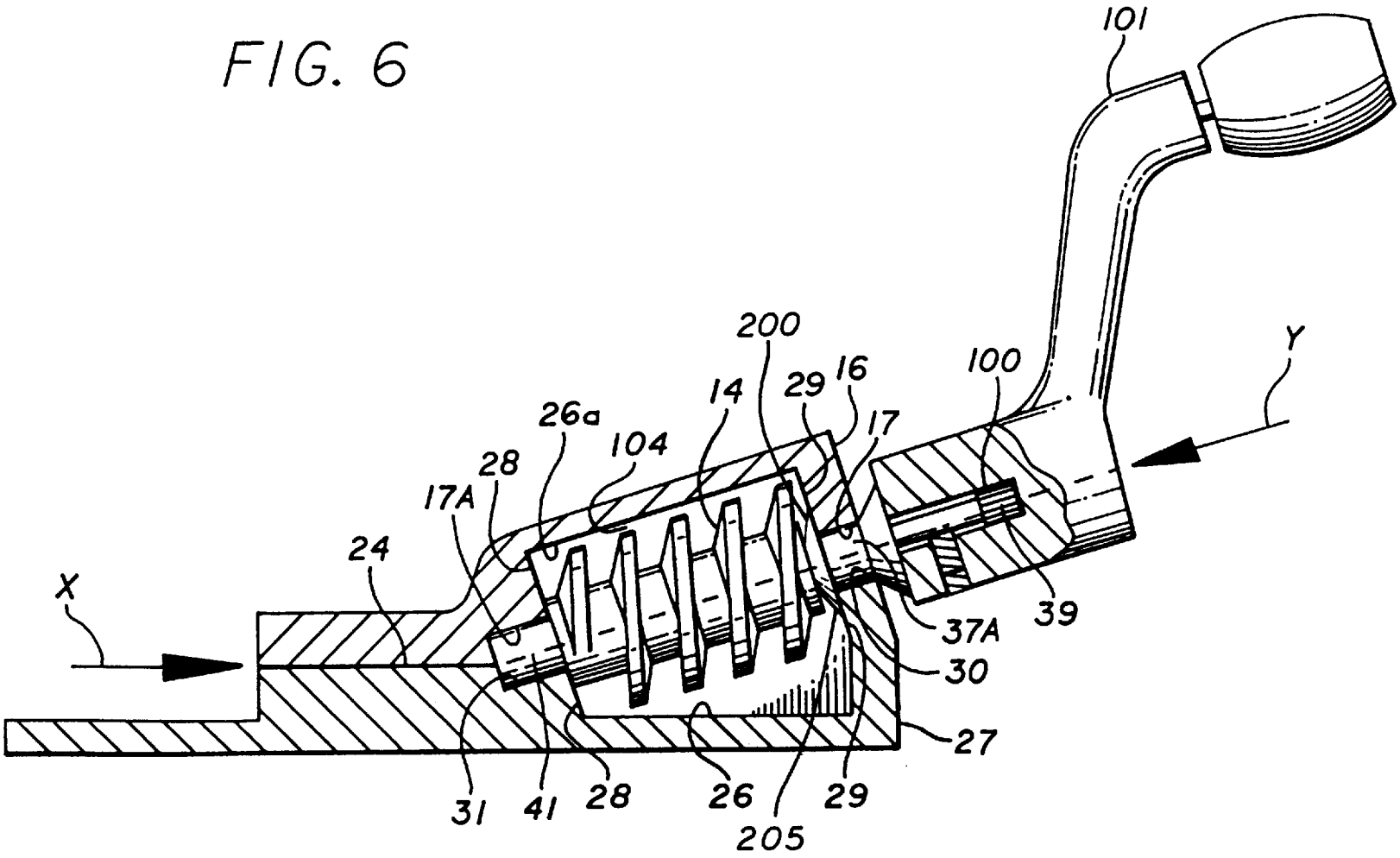
FIG. 6 is a view similar to FIG. 4 of an embodiment of the invention.
Figure 7:
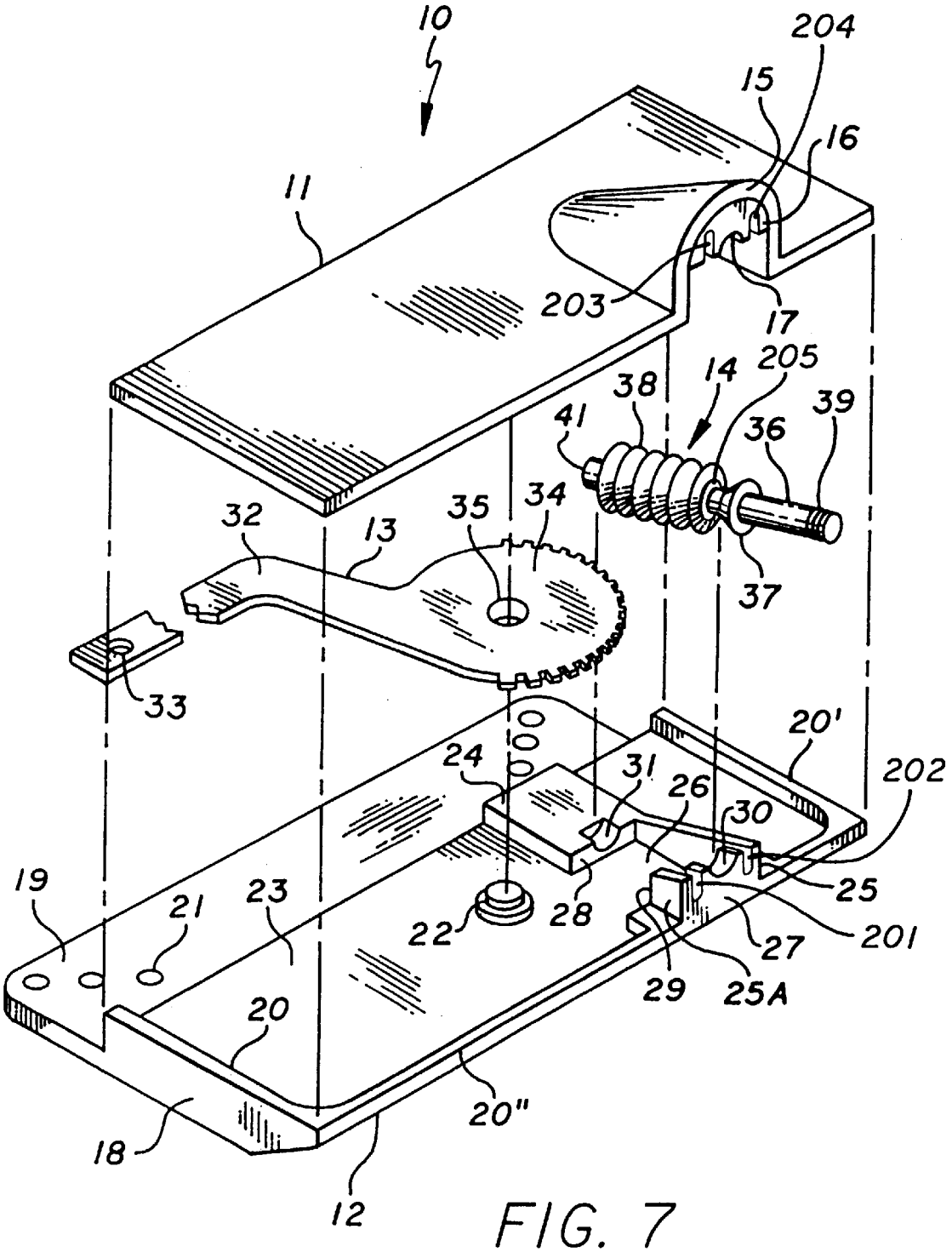
FIG. 7 is a view similar to FIG. 1 illustrating the embodiment of FIG. 6.

As seen in FIG. 6, wherein like numerals refer to like parts of FIG. 4, upper top cover 11 and base 12 are molded so that the receiving pocket for the worm gear portion 38 of worm gear 14 is too small in length so that the worm gear portion 38 must be forced radially into such smaller space. The raised portion 15 of top cover 11 and end wall 27 of base 12 are molded with two vertical slots 201, 202 (FIG. 7) on opposite sides of bearing surface 30 (in base 12) and two vertical slots 203, 204 on opposite sides of bearing surface 17 (in top cover 11). These slots 201 to 204 act to partially isolate the center portions between the slots. These center portions are molded slightly thicker on the inside at thickened portions 200, 205—see FIG. 6—(facing cavity 26) which create an interference with worm gear portion 38 as discussed above. Since the interference is created only by the thickened portions 200, 205 between slots 201 to 204, these thickened portions 200, 205 allow the center portions between slots 201 to 204 to bend outwardly as the worm gear portion 38 is forced into the seated position shown in FIG. 6. The worm gear portion 38 is thereby captured axially into the spring like action provided by the thickened portions 200, 205 and the center portions between the slots 201 to 204.

It is noted that ordinary plastics have the tendency to creep under pressure or load. That is, they back away from a constant force over time, thereby losing their original configuration and lose spring tension over time. However, glass fiber may be added into the plastic formulation prior to molding thereby creating a permanent memory in the plastic fiberglass matrix thereby creating the permanent spring effect required.

The proper spring effect can be manipulated by 1) varying the percentage of glass fiber content in the plastic; 2) varying the length of the glass fibers; and 3) varying the geometry of the length and thickness of the center portions between the slots and the thickened portions. This embodiment results in an operator in four parts that does not require mechanical procedures and adjustments of various machine components as does the apparatus in U.S. Pat. No. 4,505,601.

It's also important to note that the glass fiber content of the plastic provides substantial stiffness and strength to the housing itself. This is necessary and desirable especially when an open window comes under strong gusty wind loads. Very recent state of the art in plastics sees low cost plastics that previously could not withstand high working loads; now, with the addition of glass fiber, one is able to replace metal components at a relatively competitive price. Such glass fibers could of course be formulated into the plastic in either embodiment of the invention.

It can be seen that I have disclosed a window operator that is most useful in coastal area (salt) where conventional window operators having bi-metal contact areas deteriorate rapidly due to electrolysis. My invention has only one metal to metal contact area (the engagement of the worm gear to the geared actuating arm). In order to minimize corrosion at that point, the worm gear may be made from bronze and the arm may be made from 300 series stainless steel. Bronze and 300 series stainless have minimal electrolysis properties and both metals are corrosion proof on their own.

Only the worm gear and the geared arm require machining; the housing requires none. All prior art window operators contain more than four components and most operators contain many more machined components adding substantial cost and corrosion points.

The window operator disclosed herein functions more smoothly and with less force than other operators. The worm gear bearing journals and the thrust faces act against the plastic of the housing. This frictional relationship of metal against plastic is much better than metal against metal especially when lubrication becomes depleted. Window operators of the type discussed herein are highly engineered apparatuses that will see intermittent high load situations and marginal lubrication conditions over their service lives. The window operators disclosed herein solve the problems encountered in use in coastal areas at relatively low cost.

Although a particular embodiment of the invention has been discussed, obviously variations thereof may occur to an artisan and the scope of the invention should only be considered to be limited by the scope of the appended claims.

I claim:

1. A window operator for opening and closing casement and awning windows comprised of a plurality of window panels coupled to one of said panels comprising:

an injection molded plastic housing consisting solely of a generally rectangular base and a generally rectangular cover, said base having an upstanding peripheral wall extending along at least part of both side edges and one elongated edge thereof interconnecting said side edges, said cover conforming to the wall and adapted to mate therewith, a worm gear mounted on said base, said base having a cavity therein for receiving one-half of said worm gear therein, said cover having a cavity for receiving the other half of said worm gear therein and an integral upstanding pivot pin on said base spaced from said cavity in said base for receiving a geared actuating arm thereon in pivotal relationship;

said worm gear having a worm gear portion of bronze or heat treated stainless steel disposed in said cavities with an integral shaft for rotating said worm gear portion, said shaft extending out of said mating cavities beyond said elongated edge, said cavities having inner walls in non-frictional contact with said worm gear portion so that said worm gear portion spins freely therein;

an actuating arm having a geared portion in driving engagement with said worm gear portion receiving said pin in a hole through said geared portion, said arm having an integral arm portion extending from said geared portion away from said geared portion and past said cover, said arm portion being adapted to be coupled to the window panel of said window, for opening and closing said windows whereby, rotating said shaft rotates said worm gear portion thus moving said handle arm portion, thereby moving said window panel; and control means associated with said cavities and said worm gear portion for controlling the frictional free rotation of said worm gear portion, said control means including said cavity in said base being provided by a first upstanding wall portion spaced from one of said side walls and from said elongated edge having a groove at the upper end thereof, and a second portion upstanding from said elongated edge also having a groove at the upper end thereof, said first portion being spaced from said second portion providing an opening for receiving said shaft of said worm gear therein, said grooves being generally aligned, said second portion higher than said first portion whereby one-half of said worm gear shaft rests in said grooves in said base with said shaft extending beyond said second portion and the other half of said worm gear shaft is disposed in like configured grooves in downwardly extending wall portions in said cover, said control means further comprising said grooves in said cover receiving a portion of said shaft therein, and friction regulating means comprising said worm gear portion having a thrust face end bearing against and trapped between thickened portions associated with said mating grooves in said base and said cavity, and slots on each side of said both base and said cover adjacent said elongated edge whereby said thickened portions bear against the thrust face end of said worm gear portion and said slots bend outwardly under the spring action of said thickened portions bearing on the thrust face end of said worm gear portion.

2. The operator of claim 1 wherein said cover is glued to said base at the point of contact of said cover with said wall.

3. The operator of claim 1 wherein glass fibers are molded into said plastic housing.

4. The operator of claim 2 wherein said integral pin is of injection molded plastic molded on said base.

5. The operator of claim 1 wherein said cover has a hole therein in a supporting and strengthening relationship receiving said pin therein.

6. The operator of claim 1 wherein said base includes an apertured flange portion integral with the elongated side of said base opposite said first mentioned elongated side.

7. The operator of claim 1 wherein said cover includes a domed portion aligned with said worm gear position for trapping said worm gear position therein.

8. The operator of claim 1 wherein said arm is of stainless steel.

* * * * *